US009221057B2

(12) United States Patent
Blanchard et al.

(10) Patent No.: US 9,221,057 B2
(45) Date of Patent: Dec. 29, 2015

(54) PLANETARY MILL AND METHOD OF MILLING

(71) Applicant: n-WERKZ Inc., Verdun (CA)

(72) Inventors: Pierre Blanchard, St-Paul d'Abbotsford (CA); Tony Addona, Verdun (CA); George E. Kim, Verdun (CA)

(73) Assignee: N-WERKZ INC., Verdun (CA)

( * ) Notice: Subject to any disclaimer, the term of this patent is extended or adjusted under 35 U.S.C. 154(b) by 389 days.

(21) Appl. No.: 13/688,666

(22) Filed: Nov. 29, 2012

(65) Prior Publication Data

US 2013/0134242 A1 May 30, 2013

Related U.S. Application Data

(60) Provisional application No. 61/564,651, filed on Nov. 29, 2011.

(51) Int. Cl.

| | |
|---|---|
| ***B02C 17/00*** | (2006.01) |
| ***B02C 17/08*** | (2006.01) |
| ***B02C 17/24*** | (2006.01) |
| ***B02C 17/18*** | (2006.01) |

(52) U.S. Cl.

CPC ..... *B02C 17/00* (2013.01); *B02C 17/08* (2013.01); *B02C 17/1815* (2013.01); *B02C 17/1885* (2013.01); *B02C 17/24* (2013.01)

(58) Field of Classification Search

CPC ..... B02C 19/186; B02C 17/16; B02C 17/14; B02C 17/00; B02C 17/1885; B02C 17/24; B02C 17/08; B02C 17/1815

USPC ..... 241/65, 66, 175

See application file for complete search history.

(56) References Cited

U.S. PATENT DOCUMENTS

| | | | | |
|---|---|---|---|---|
| 2,937,814 | A | | 5/1960 | Joisel |
| 3,104,836 | A | | 9/1963 | Meyers |
| 3,201,273 | A | * | 8/1965 | Maker et al. ..... 427/11 |
| 3,401,876 | A | | 9/1968 | Lucas |
| 3,747,842 | A | | 7/1973 | Grubb et al. |
| 4,718,199 | A | * | 1/1988 | Harper, Jr. ..... 451/329 |
| 5,314,125 | A | | 5/1994 | Ohno |
| 5,364,036 | A | * | 11/1994 | Falcon-Steward ..... 241/21 |
| 5,375,783 | A | | 12/1994 | Gamblin |

(Continued)

FOREIGN PATENT DOCUMENTS

WO 00/71258 A1 11/2000

OTHER PUBLICATIONS

International Search Report of PCT/CA2012/050861, mailed Feb. 14, 2013.

*Primary Examiner* — Faye Francis
*Assistant Examiner* — Onekki Jolly
(74) *Attorney, Agent, or Firm* — Gordreau Gage Dubuc; Hugh Mansfield

(57) ABSTRACT

A planetary mill is disclosed. The planetary mill comprises a self-balancing milling assembly comprising a pair of elongate floating milling chambers arranged in parallel to and on opposite sides of a main axis wherein the milling chambers are free to move outwards in a direction radial to the main axis, a drive assembly for rotating the milling assembly in a first direction of rotation about the main axis, and at least one of belt surrounding the pair of floating milling chambers such that when the milling assembly rotates about the main axis, the at least one belt limits a radial travel outwards of each of the milling chambers.

14 Claims, 11 Drawing Sheets

(56) References Cited

U.S. PATENT DOCUMENTS 6,086,242 A 7/2000 Rajamani et al.
6,126,097 A * 10/2000 Chen et al. ..... 241/27
6,334,583 B1 * 1/2002 Li ..... 241/175
7,744,027 B2 6/2010 Nagao
2001/0016467 A1 8/2001 Weichert

* cited by examiner

PLANETARY MILL AND METHOD OF MILLING

CROSS REFERENCE TO RELATED APPLICATIONS

This application claims benefit, under 35 U.S.C. §119(e), of U.S. provisional application Ser. No. 61/564,651, filed on Nov. 29, 2011

FIELD OF THE INVENTION

The present invention relates to a planetary mill and method of milling. In particular, the present invention relates to a high G force floating planetary mill with cooling system.

BACKGROUND TO THE INVENTION

Planetary mills capable of generating large gravitational, or G, forces on powders being processed are expensive to build and difficult to balance due to their high rotational speeds. Additionally, given the heat generation created by the milling process and friction of the rotating components, cooling is required to avoid damaging critical parts when operating continuously for long periods of time as well as to maintain the powders being milled at cool temperatures. Insufficient heat transfer and heating up of the components during operation may result in damage due to expansion given the tight tolerances required for a well-balanced and operating planetary mill as well as substandard milled powders. Key components which must be cooled include, for example, the large bearings typically used to support the milling chambers.

Prior art cooling methods include a simple direct contact method wherein a cooling fluid such as water, is directed towards the components to be cooled using spray jets. The effectiveness of this method is however limited by the design of the spray jets and the effective contact surface area for heat transfer. Alternatively, the components can be internally cooled, however the design of such a cooling system is very complex due to the high rotational speeds of the components.

Additionally, given the large centrifugal forces which are brought to bear on the rotating components of the planetary mill system, the components must be re-enforced or may have a limited capacity, thereby increasing costs of the assembly and reducing the cost effectiveness of milling using the assembly.

SUMMARY OF THE INVENTION

In order to address the above and other drawbacks there is provided a planetary mill comprising a self-balancing milling assembly comprising a pair of elongate floating milling chambers arranged in parallel to and on opposite sides of a main axis wherein the milling chambers are free to move outwards in a direction radial to the main axis, a drive assembly for rotating the milling assembly in a first direction of rotation about the main axis, and at least one of belt surrounding the pair of floating milling chambers such that when the milling assembly rotates about the main axis, the at least one belt limits a radial travel outwards of each of the milling chambers.

There is also provide a method for operating a pair of elongate milling chambers comprising arranging the milling chambers on either side of and in parallel to a first horizontal central axis, rotating the pair of milling chambers in a first direction of rotation about the first axis wherein the pair of milling chambers are able to travel freely in a direction radial to the first direction of rotation, limiting a travel of each of the pair of milling chambers in the direction radial to the first direction of rotation such that when one of the pair of milling chambers moves outwards a given distance another of the pair of milling chambers moves inwards the given distance.

Additionally, there is provided a mill comprising a pair of elongate cylindrical milling chambers arranged in parallel to and on opposite sides of a main axis, a drive assembly for rotating the milling assembly in a first direction of rotation about the main axis and at least one belt surrounding the pair of milling chambers and positioned towards a center thereof.

BRIEF DESCRIPTION OF THE DRAWINGS

In the appended drawings:

FIGS. 6A through 6C provide an example of an aluminum powder to be milled using the planetary mill of the present invention at progressively increasing magnifications.

DESCRIPTION OF ILLUSTRATIVE EMBODIMENTS

The present invention is illustrated in further details by the following non-limiting examples.

Figure 1:
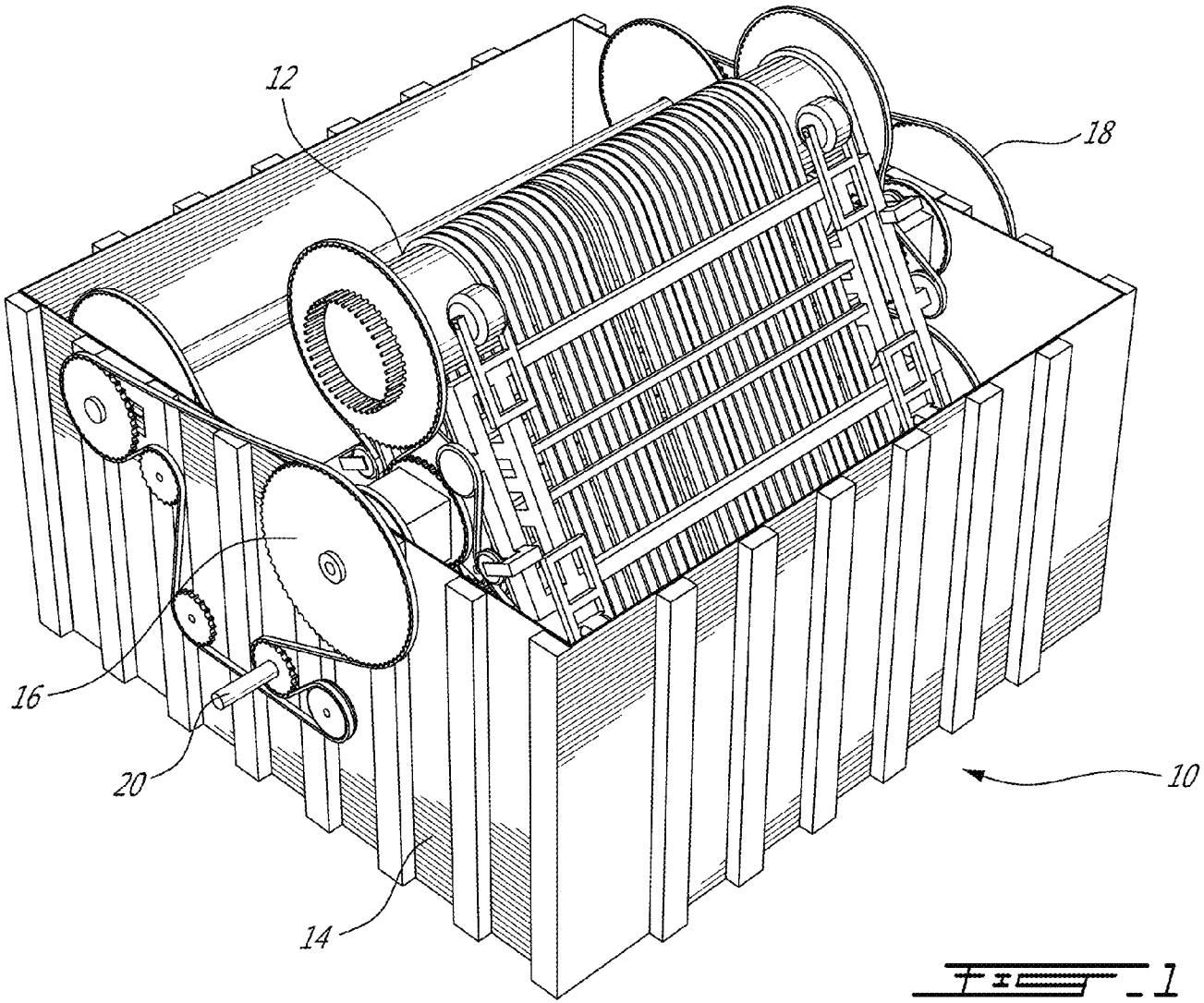
FIG. 1 is a raised left front perspective view of a planetary mill in accordance with an illustrative embodiment of the present invention.

Referring now to FIG. 1, and in accordance with an illustrative embodiment of the present invention, a planetary mill generally referred to using the reference numeral 10, will now be described. The planetary mill 10 comprises a self balancing milling assembly 12 which is positioned within a housing 14 and a pair of drive assemblies 16, 18. The housing 14, only one half of which is shown, encloses the milling assembly 12 and provides for sound and heat insulation and containment of cooling fluids and the like. The housing 14 also provides support for the milling assembly 12 and in this regard is manufactured from a material such as reinforced sheet steel or the like, which is of sufficient rigidity and strength to support the weight of the milling assembly 12 and the forces generated by the milling assembly 12 during operation.

Still referring to FIG. 1, a source of rotational power (not shown) such as a large (illustratively 100 hp) dedicated motor or other machinery having a Power Take Off (PTO) such as tractor or the like, is attached to the drive pinion 20 for powering the mill. Additionally, a cooling system (also not shown) comprised of a source of coolant as well as a system of pumps, pipes and nozzles within the housing 14 for directing the coolant onto the milling assembly 12 is also provided. Alternatively, and in a particular embodiment, the milling assembly 12 can be operated cryogenically by submersing the milling assembly 12 in liquid nitrogen (also now shown).

Figure 2:
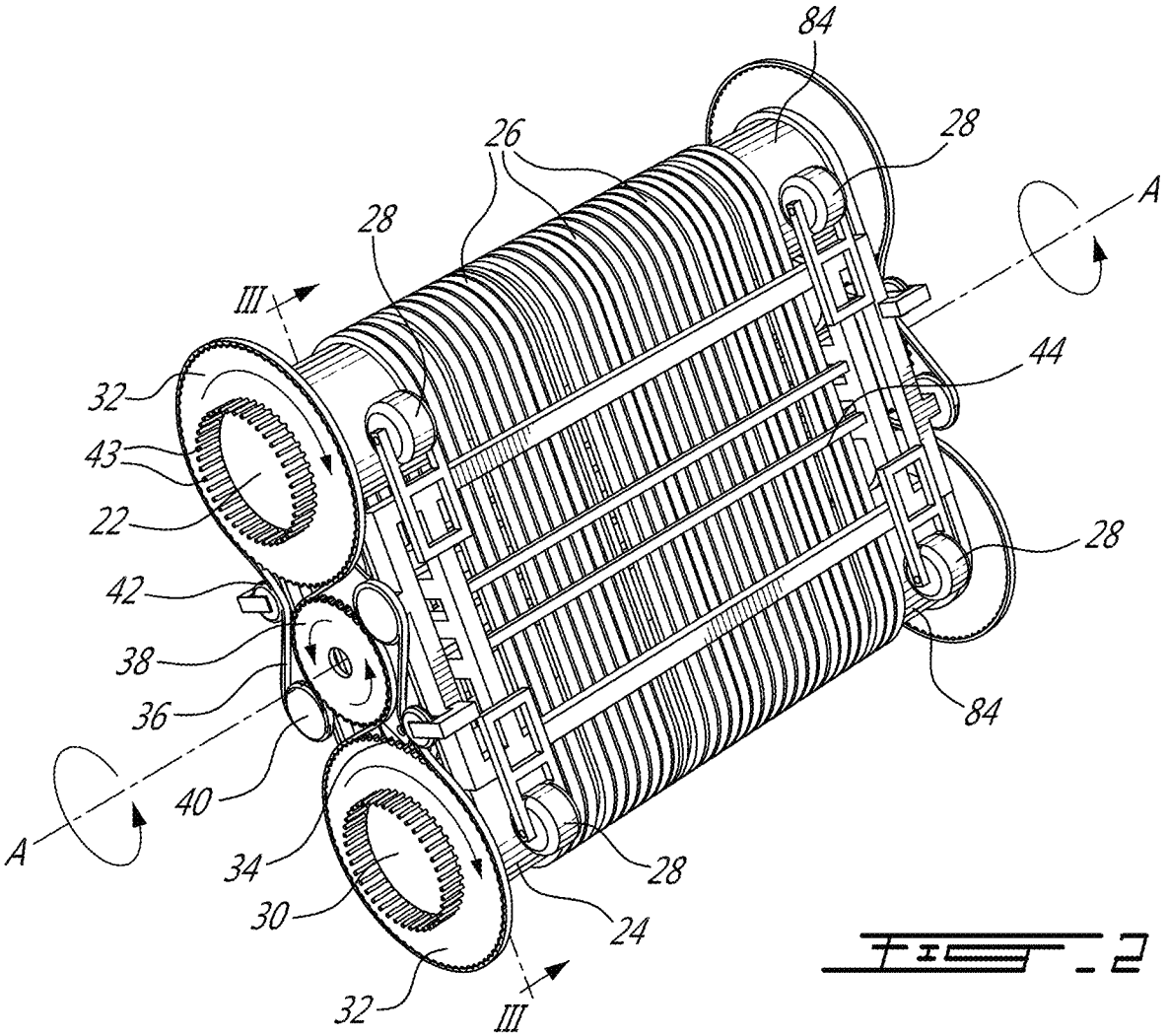
FIG. 2 is a raised left front perspective view of a milling assembly in accordance with an illustrative embodiment of the present invention.

Referring now to FIG. 2, the self balancing milling assembly 12 comprises a pair of opposed elongate floating milling chambers 22, 24. The milling chambers 22, 24 are arranged in parallel to and on opposite sides of a main axis A. The milling chambers 22, 24 are generally free floating and free to move outwards in a direction radial to the main axis A but are held in place by a plurality of belts as in 26 arranged side-by-side and surrounding the milling chambers 22, 24. Additionally, opposed rubber wheels as in 28 serve to limit travel of the milling chambers 24, 26 in a direction tangential to the main axis A. As will be seen below, allowing the milling chambers 22, 24 to float freely outwards in this manner allows the milling assembly 12 to be self balancing, thereby allowing higher speeds of operation and/or reducing noise. Furthermore, given the high rotational forces that are brought to bear on the milling chambers 22, 24, the absence of bearings as the means for holding the milling chambers in place increases the durability of the milling assembly 12 and reduces maintenance. Additionally, as the bearings otherwise required to support each of the milling chambers 22, 24 are necessarily quite large, and therefore heavy, given the forces involved, provision of the plurality of belts as in 26 reduces the overall weight of the milling assembly 12. The belts as in 26 are fabricated from a strong corrosion resistant material which is capable of conducting heat, such as a steel chain belt (roller chains) or the like. A further advantage of using belts as in 26 to support the milling chambers 22, 24 as opposed to bearings or the like is that the milling chambers 22, 24 do not have to be machined, which is typically expensive.

As discussed above, in a particular embodiment the belts 26 are chain belts comprised of a plurality of links (not shown). In order to reduce rolling friction and allow for smooth rotation the links of the chain belt should be of relatively small pitch versus the diameter of the milling chambers 22, 24 should be used. In practice, chains having a pitch which is less than about $1/8^{th}$ the radius of the outer circumference of the milling chamber have proved effective. In a particular embodiment, several or all of the plurality of belts 26 can be replaced by a single wide belt, for example a multi-strand chain belt or the like.

Still referring to FIG. 2, each milling chamber as in 22, 24 comprises a hollow drum 30 into which the powder and media are placed, and a sprocket as in 32 at either end of the drum comprising a plurality of teeth 34. Each sprocket 32 is driven by a planetary drive belt as in 36, for example manufactured from a corrosion resistant material such as steel chain belt, polyurethane, or composites such as carbon fiber and the like, which is in turn driven by a driving sprocket 38. Given that the timing belt 36 is being driven on the outside by the driving sprocket 38, a wheel 40 is provided. Additionally, in order to maintain tension on the timing belt 36, a tensioning pulley 42 is provided. As will now be apparent to a person of ordinary skill in the art, as the driving sprocket 38 is rotated in a direction around a first axis A, each of the milling chambers 22, 24 is rotated in the opposite direction, as indicated. A series of protruding bolts as in 43 are provided at either end each of the milling chambers 22, 24 for attaching a removable sealing plate (not shown) thereby retaining the material being milled within the drum 30.

An additional advantage of supporting the milling chambers 22, 24 by one or more belts as in 26 in this manner is that, given the countering support which is provided via the belts during operation, a much longer drum 30 can be used (or one with a thinner sidewall) thereby improving the overall capacity of the assembly, or allowing milling chambers 22, 24 of less costly construction to be used. The belts, therefore, could also be used with a mill assembly comprising chambers supported at either end, for example by a bearing or the like, in order to improve overall capacity.

Still referring to FIG. 2, the rubber wheels as in 28 are held in place by a metal framework 44 which rotates with the mill.

Figure 3:
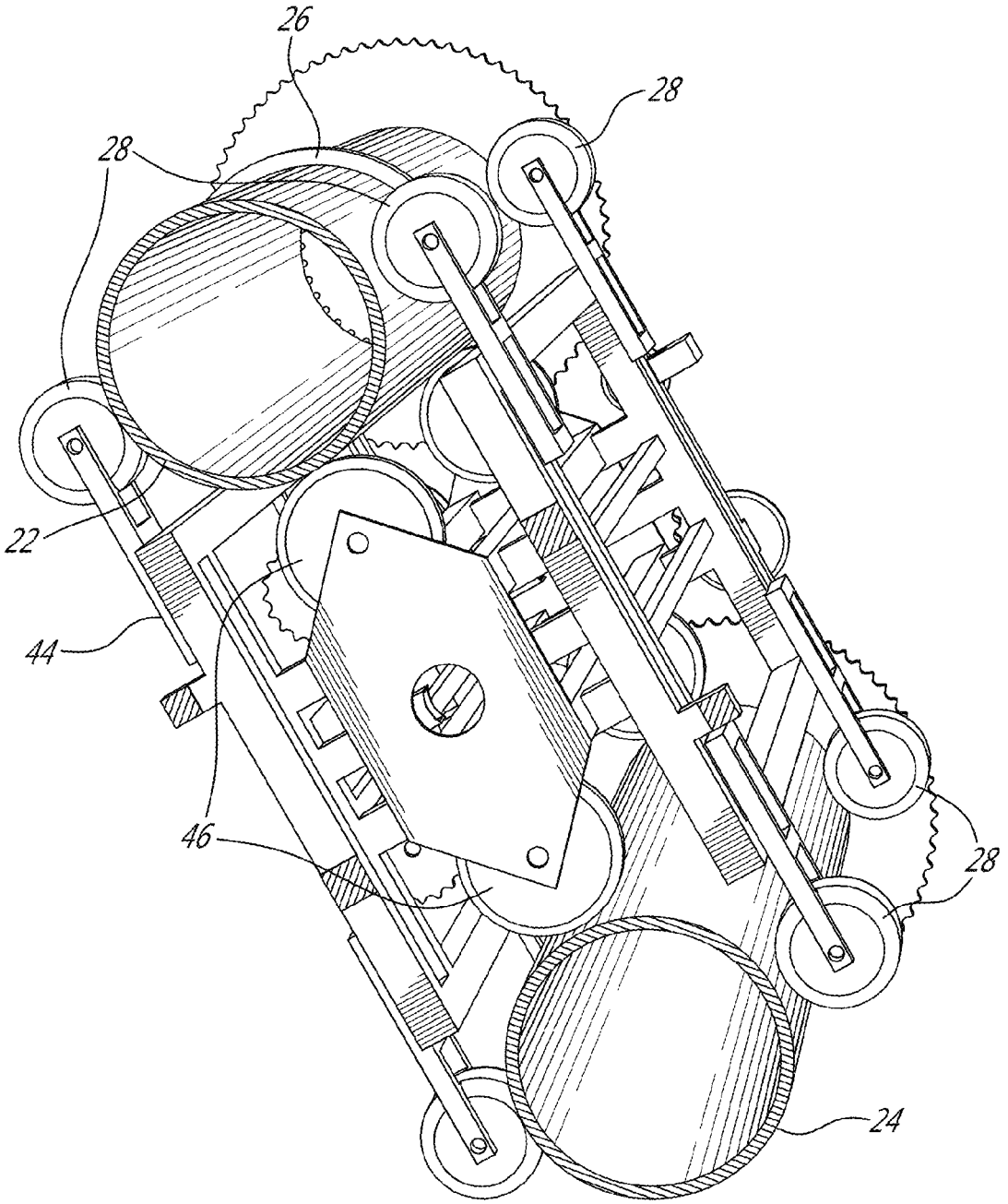
FIG. 3 is a cutaway perspective view along line III-III in FIG. 2.

Referring to FIG. 3, as discussed above, the mill chambers 22, 24 are generally free floating but held in place by a plurality of belts as in 26 and opposed rubber wheels as in 28. A further set of rubber wheels as in 46 ensures that the milling chambers 22, 24 remain positioned firmly against the plurality of belts as in 26 during both loading of the chambers and operation. The wheels as in 46 support the mill chamber 22, 24 during loading and also maintain the mill chambers 22, 24 as close as possible to their respective trajectories when spinning at maximum speed. Additionally, the mill chambers 22, 24 are made from cylinders which are not perfectly round and therefore manufacture of the wheels 46 from a flexible material such as rubber allows them to flex to compensate.

Figure 4:
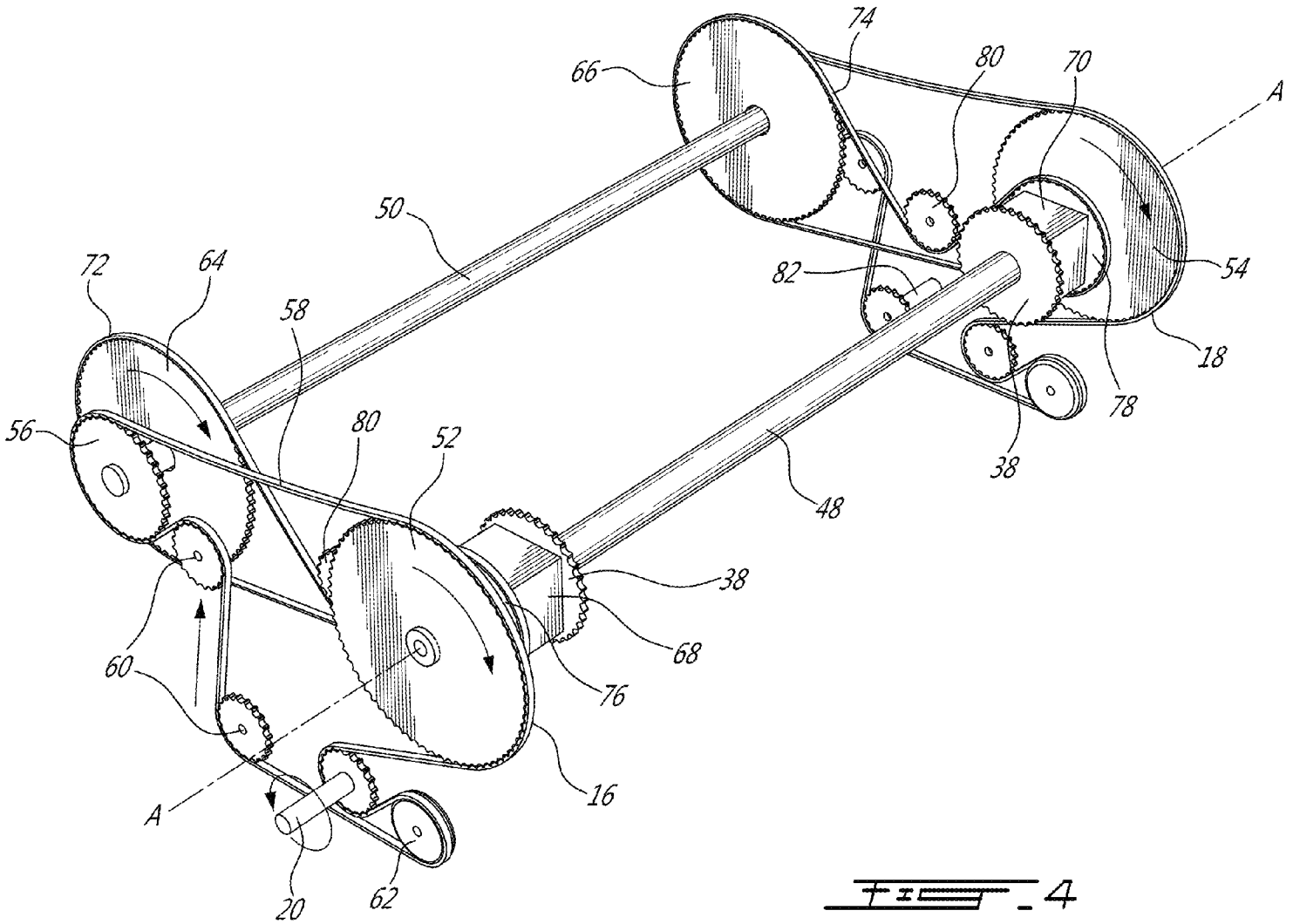
FIG. 4 is a raised left front perspective view of a drive assembly for a planetary mill in accordance with an illustrative embodiment of the present invention.

Referring now to FIG. 4, the drive assemblies as in 16, 18 are interconnected by a main drive shaft 48 and a counter drive shaft 50. A pair of drive sprockets 52, 54 are positioned towards respective ends of the main drive shaft 48. Similarly, a pair of counter drive sprockets 56 (one of which is not shown) is positioned towards respective ends of the counter drive shaft 50. A drive belt 58, such as a steel chain belt or the like, interconnects the drive pinion 20 with its respective drive sprocket 52 and respective counter drive sprocket 56. A pair of additional sprockets as in 60 as well as a tensioning pulley 62 are provided to ensure the correct path of travel for the drive belt 58, that tension is maintained on the drive belt 58 and that a sufficient amount of drive belt 58 is in contact with a given one of the sprockets at all times. A person of ordinary skill in the art will now understand that when a rotational source of power is applied to the drive pinion 20, the rotational force is transferred via the drive belt 58 to the main drive shaft 48 and the counter drive shaft 50. A person of skill in the art will also appreciate that given the different radii of the main drove sprocket 52 and the counter drive sprocket 56, the counter drive shaft 50 will rotate more quickly than the main drive shaft 48.

Still referring to FIG. 4, a second pair of drive sprockets 64, 66 are attached to the counter drive shaft 50 for rotation therewith. Each of the second pair of drive sprockets 64, 66 is interconnected with a respective mill chamber drive assembly 68, 70 via a pair of second drive belts 72, 74. The mill chamber drive assemblies 68, 70 are able to rotate freely about the main drive shaft 48 through provision of a bearing or bushing or the like (not shown). Each of the mill chamber drive assemblies 68, 70 comprises a driven sprocket 76, 78 which is driven by a respective one of the second drive belts 72, 74 and a driving cog, 38, which as discussed above in reference to FIG. 2, provides the rotational force for rotating the mill chambers 22, 24. Of note is that each of the second pair of drive sprockets 64, 66 is larger than its respective driven sprockets as 76, 78. A person of ordinary skill in the art will therefore now understand that the mill chamber drive assemblies 68, 70, and therefore the driving cogs as in 38, spin about the main drive shaft 48 at a rate which is much higher than that of the main drive shaft 48. A tensioning sprocket as in 80 is also provided to ensure that the second drive belts 72, 74 remain under tension and that a sufficient amount of the second drive belts 72, 74 remain in contact with a given one of the sprockets at all times.

Still referring to FIG. 4, it will be noted that the planetary mill as illustrated comprises two matched drive assemblies 16, 18 and a second drive pinion 80, thereby allowing a second independent source of rotational power to be attached. Alternatively, the second drive pinion as in 82 could be interconnected to the drive pinion 20 of a second planetary mill (not shown) allowing two (or more) mills to be driven by the same source of power. In an alternative embodiment, only a single drive assembly as in 16, 18 could be provided for.

Figure 5:
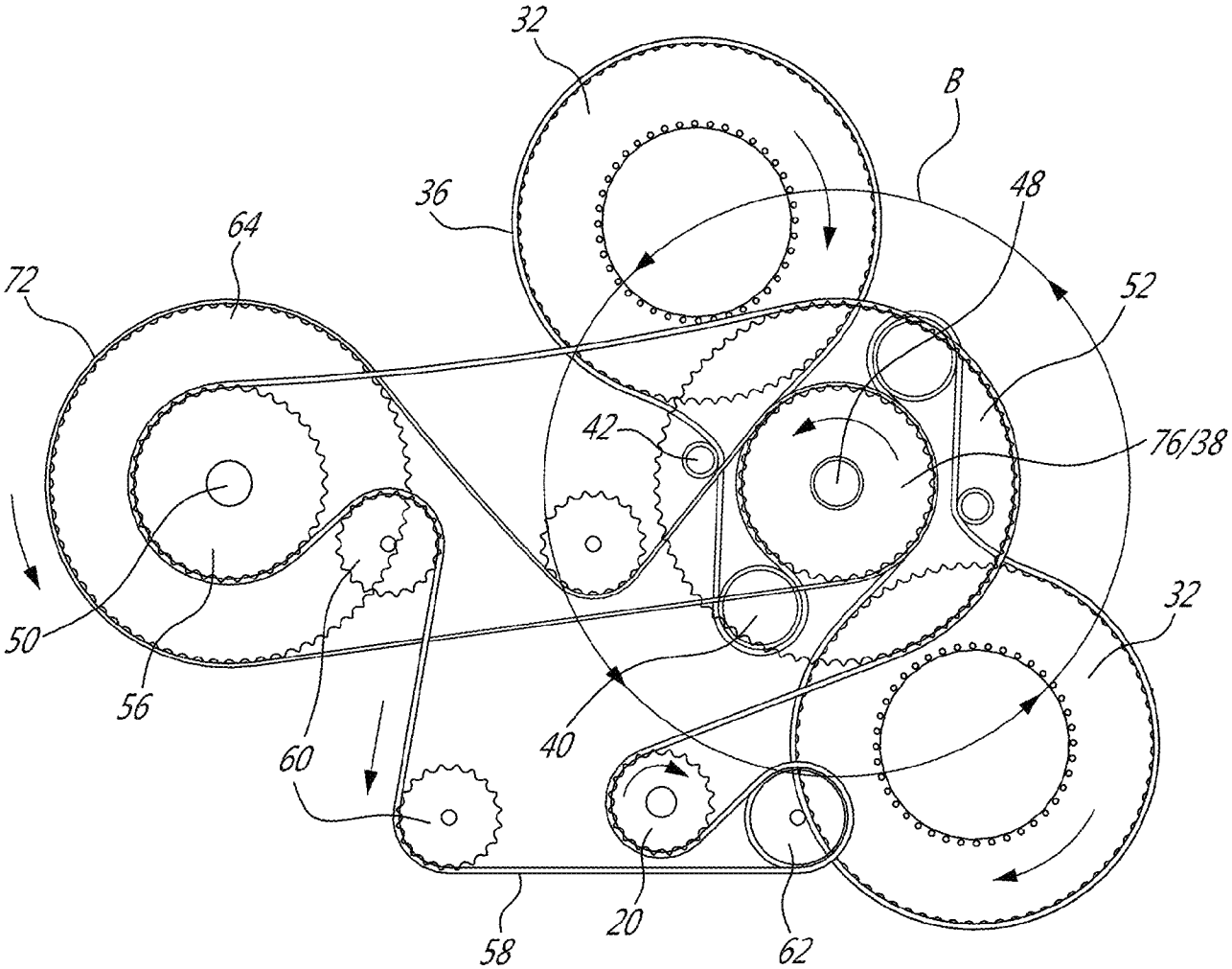
FIG. 5 is a side plan view of a drive assembly detailing the paths of the drive belts and in accordance with an illustrative embodiment of the present invention.

Referring now to FIG. 5, as discussed above a rotational force (illustratively counter clockwise) is applied to the drive pinion 20 which in turn drives the main drive shaft 48 and the counter drive shaft 50 via the drive belt 58 in a clockwise direction. As discussed above, it will be apparent to a person of skill in the art that given the relative sizes of the drive pinion 20 and the drive sprocket 52 and second drive sprocket 64, the main drive shaft 48 revolves at a rate which is slower than that of the counter drive shaft 50. The speed of revolution of the main drive shaft 48 determines the speed at which the milling chambers 22, 24 orbit about the axis of the main drive shaft 48 (see axis A as detailed in FIGS. 2 and 4) in a clockwise direction along the orbital path B.

Still referring to FIG. 5, the second drive sprocket 64 drives the driven sprocket 76, and therefore the driving sprocket 38, via the second drive belt 72. Referring back to FIG. 2 in addition to FIG. 5, the driving sprocket 38 in turn drives the pair of planetary driver belts 36 which rotate the milling chambers 22, 24 about a respective axis of each of the milling chambers 22, 24 in a direction opposite to that of the milling assembly 12 (in this case, counter clockwise) thereby creating a planetary milling motion. Note that although the milling chambers 22, 24 in the present illustrative embodiment are shown rotating in a direction opposite to that of the milling assembly 12, in a particular embodiment, and with appropriate modification to the drive assemblies 16, 18, the milling chambers 22, 24 could be rotated in the same direction as that of the milling assembly 12.

Still referring to FIG. 5, as will now be understood by a person of ordinary skill in the art the speed or rate of rotation of the milling assembly 12 versus that of the milling chambers 22, 24 can be determined through appropriate selection of the relevant sprockets. Typically, the milling chambers 22, 24 revolve at a rate which is somewhat higher than that of the milling assembly 12, illustratively between two (2) and four (4) times, although there is not actual limit. Although selection will depend to some degree on the particular application of the planetary mill 10, in one embodiment the milling assembly 12 revolves around the main axis A at 150 RPM and the milling chambers 22, 24 about their respective axis at 300 RPM.

Referring back to FIG. 1, in a particular embodiment the planetary mill 10 further comprises a gas delivery system for introducing a protective gas, such as nitrogen or Argon or the like, into the milling chambers 22, 24. In this regard the main drive shaft 48 driving the mill is hollow and is fitted inside with a flexible tube, for example a plastic tube (not shown) for delivering the gas which enters the shaft at one end and exits the shaft approximately half way along its length at an angle. The tube is attached to the metal framework 44 inside the plurality of belts as in 26 and positioned such that it passes outside of the framework 44 between the sprockets and drive belts. The tube is terminated by a T connector with one branch of the T extending to an end of their respective milling chambers 22, 24. Each branch is attached to its respective milling chamber 22, 24 using a swivel (also not shown) allowing the milling chamber 22, 24 to rotate freely.

The supply of gas is attached to the free end of the hollow tube within the main drive shaft 48 using a swivel, thus allowing the main drive shaft 48 to rotate freely. In a like fashion, and in a particular embodiment, a series of return tubes can be provided allowing the gas to be circulated during operation.

The system is used to initially charge the gas and replenish the gas during operation. In an alternative embodiment, however, the milling chambers 22, 24 can simply be filled with the protective gas at the same time as the milling chambers 22, 24 are filled with the powder to be milled, and the milling chambers 22, 24 sealed.

Generally, given the high rotational and frictional forces involved as well as to achieve good heat transfer for cooling, the major elements of the planetary mill 10 are fabricated from a heat conducting corrosive resistant material such as steel or titanium or the like. Additionally, as discussed above a cooling system comprising a source of chilled coolant such as water or the like as well as pumps and a series of nozzles for spraying the coolant on the milling assembly 12 during operation is provided, although not shown. In particular, and referring back to FIG. 2, provision of a plurality of belts as in 26 in contact with an outer surface 84 of each of the hollow drums as in 30, and provided the belts are manufactured from a conductive material such as steel chain belt or the like, provides for an increased heat transfer thereby improving the overall operation of the cooling system. Additionally, given that the plurality of belts 26 are supporting the milling chambers 24, 26 during operation and are therefore in contact with the outer surface 84 of each of the hollow drums as in 30, the plurality of belts 26 serves to remove dirt and other debris from the surfaces as in 84 and to polish the outer surfaces thereby improving thermal conductivity and resultant heat transfer.

In operation, typically equal amounts of the powder to be milled are placed in one or other of the milling chambers 22, 24 together with grinding media such as stainless steel ball bearings or the like (not shown). Typically about 10 to 30 times the weight of the powder in media is required in order to achieve good results.

The planetary mill 10 of the present invention is capable of producing production quantities of nano-structured powders, for example 100-200 lbs.

One particular application of the planetary mill 12 of the present invention is to introduce nanostructures throughout the powders. By way of example, aluminum alloy 5083 (AA5083) powder was milled using the planetary mill 12 of the present invention according to the following parameters:

- Powder added to the milling chambers=−325 mesh, AA5083 (Valimet, Stockton, Calif.), tap density=1.7 g/cc; particle size distribution (Horiba LA-920 particle size analyzer): D10=6 μm; D50=14 μm; D95=40 μm; average crystallite size estimated according to the Scherrer method=204 nm;
- milling media added to the milling chambers=¼" 440C stainless steel balls (Royal Steel Ball Products, Sterling, Ill.);
- mass ratio of milling media to powder=20:1;
- rotation speed of milling assembly 12 about central axis A=150 rpm;
- rotation speed of each milling chamber 24, 26 about its respective axis=300 rpm (in an opposite direction to the rotation around central axis)
- milling time=4 hours;
- cooling fluid (water) temperature=8° C.
- milling chambers 24, 26 were flushed with nitrogen gas prior to sealing and starting the process;
- starting pressure in the milling chambers 24, 26~1 atmosphere;
- nitrogen gas was added continuously to the milling chambers 24, 26 during the milling process;

pressure in the milling chambers was monitored and maintained at slightly above 1 atmosphere throughout the process; and no surface control agent (such as stearic acid, oleic acid etc.) was used;

Addition of an inert gas to the milling chambers 24, 26 ensures that an inert atmosphere is maintained and therefore hindering oxidation and the like.

Figure 6A:
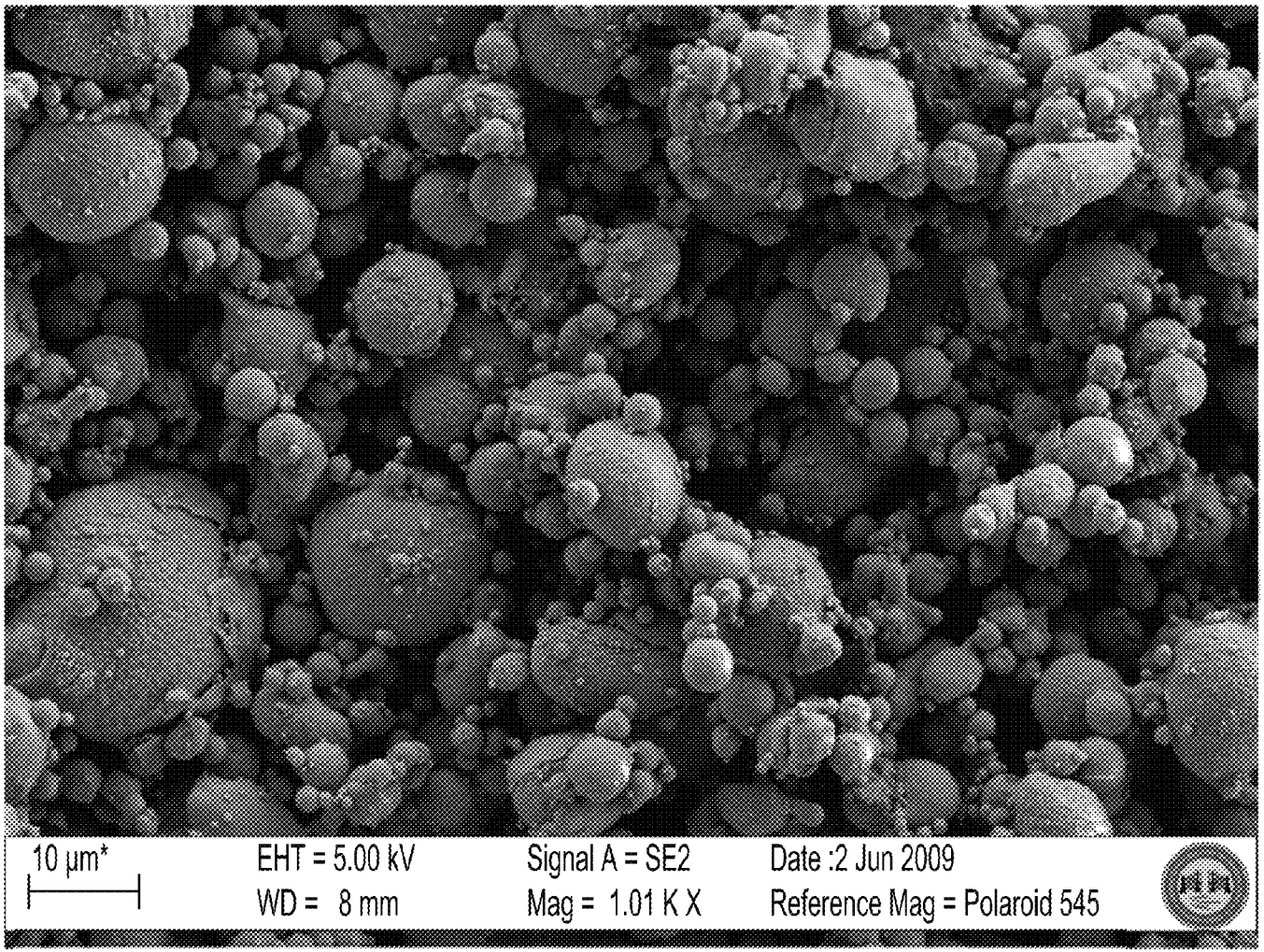
Figure 8B:
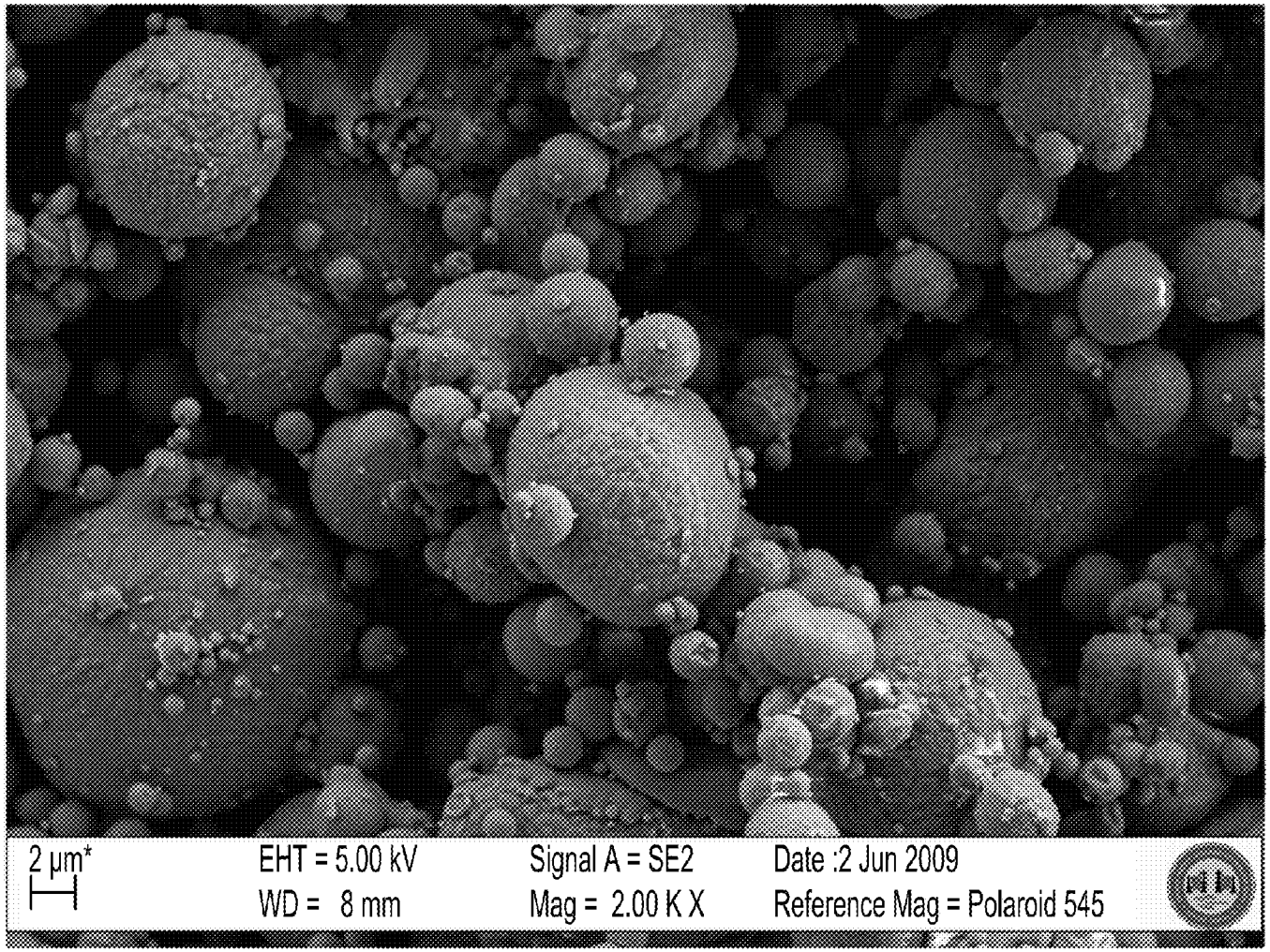
Figure 6C:
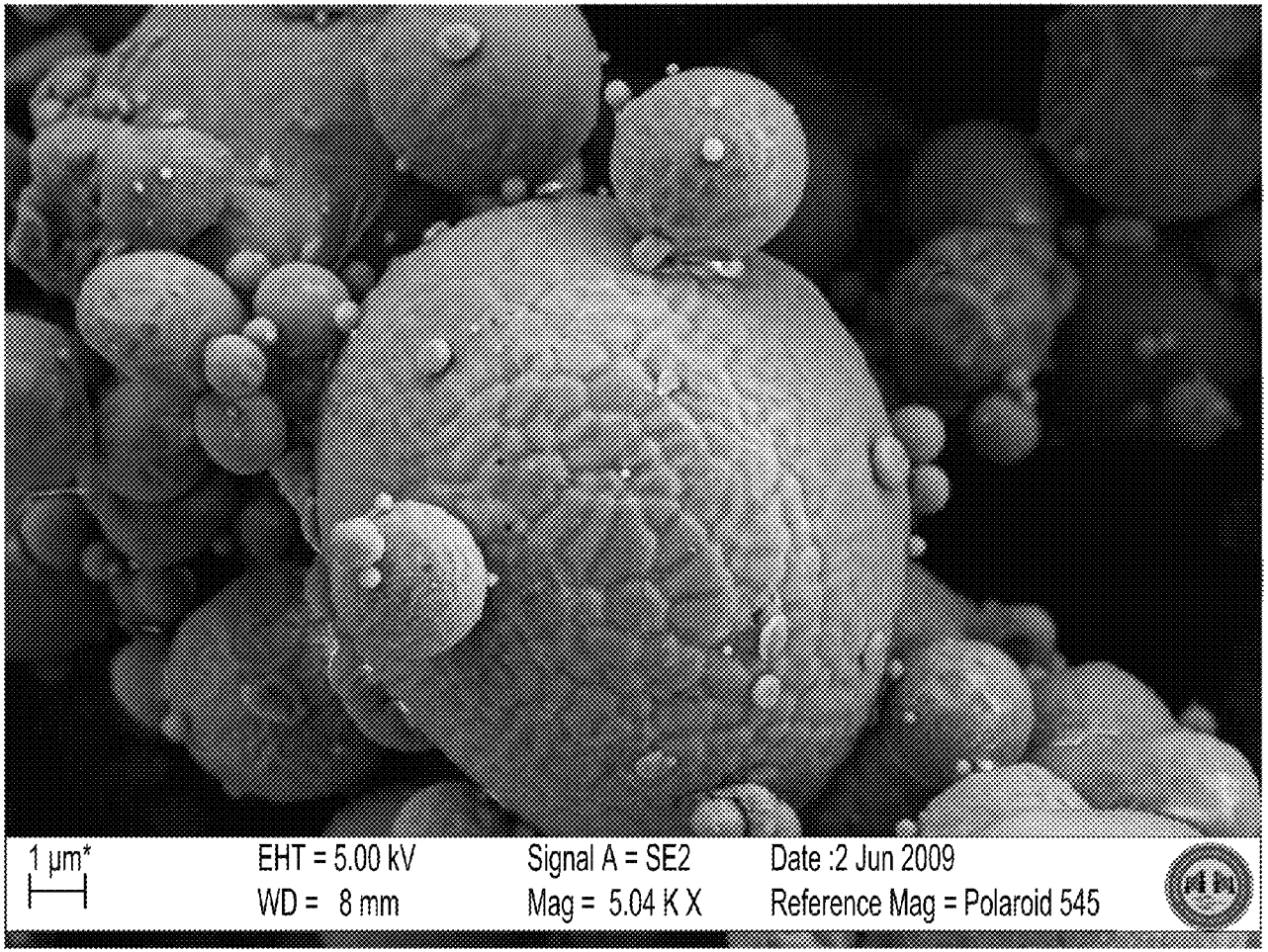
Figure 7A:
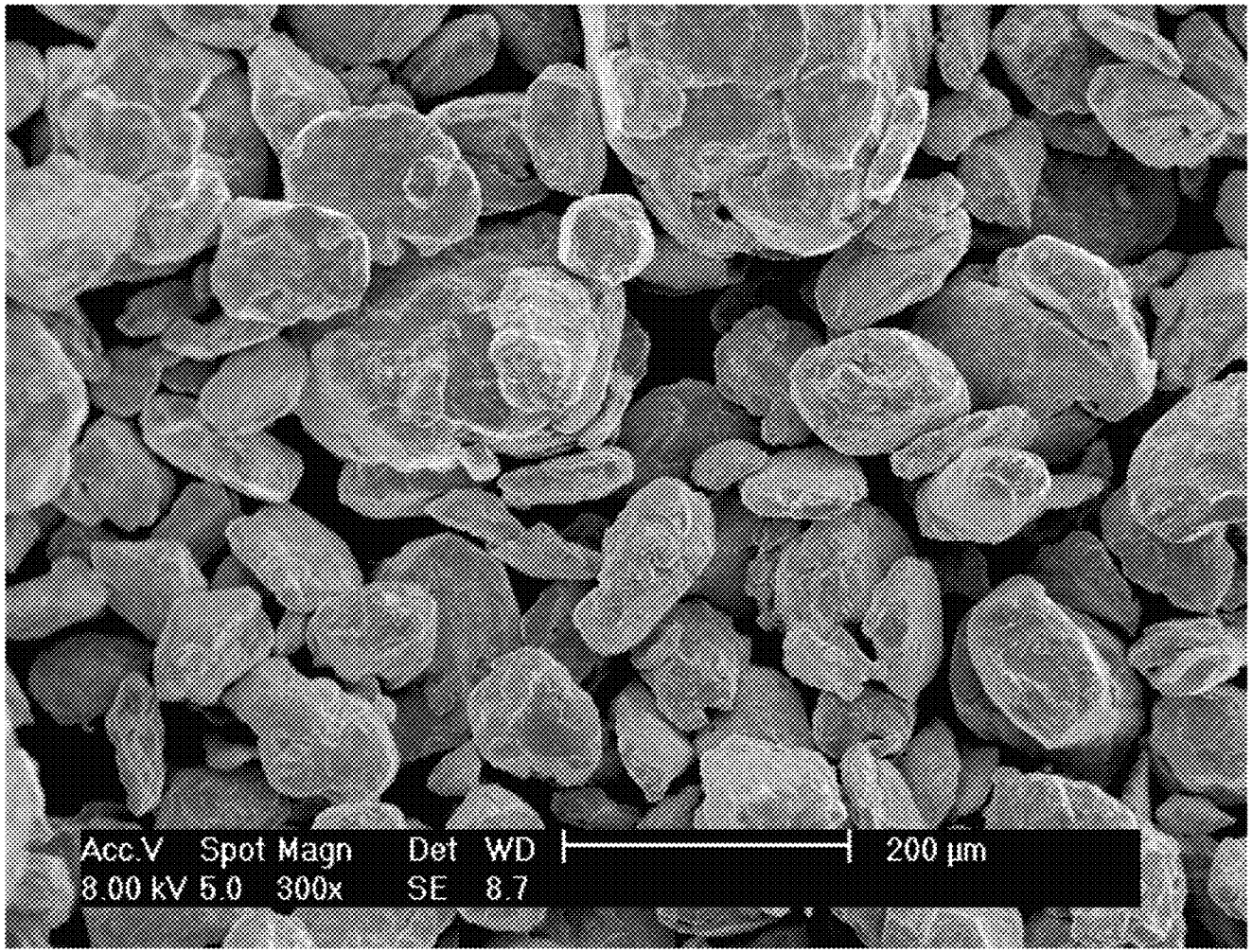
FIGS. 7A through 7C provide the same nanostructured aluminum powders of 6A through 6C following milling at progressively increasing magnifications.
Figure 7B:
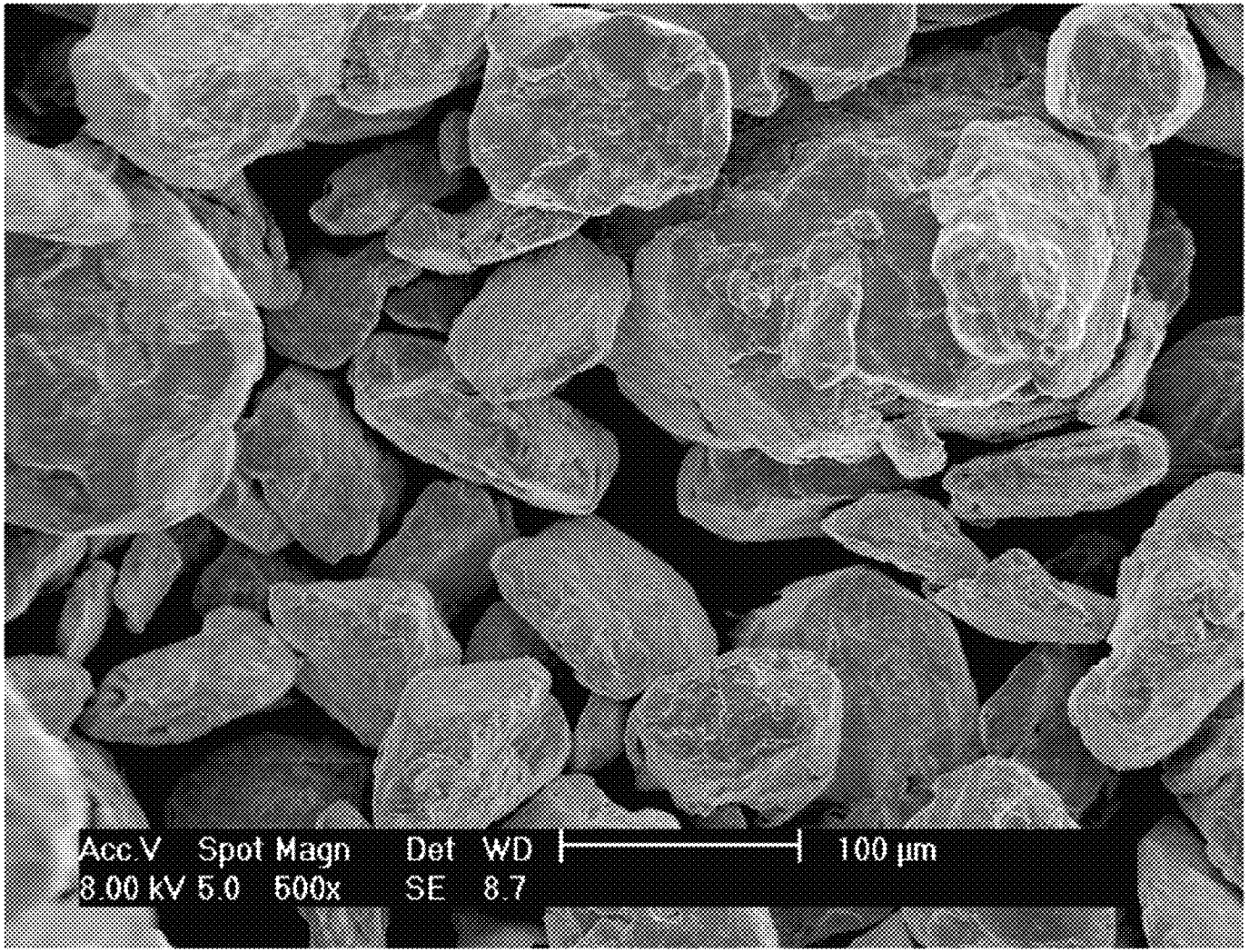
Figure 7J:
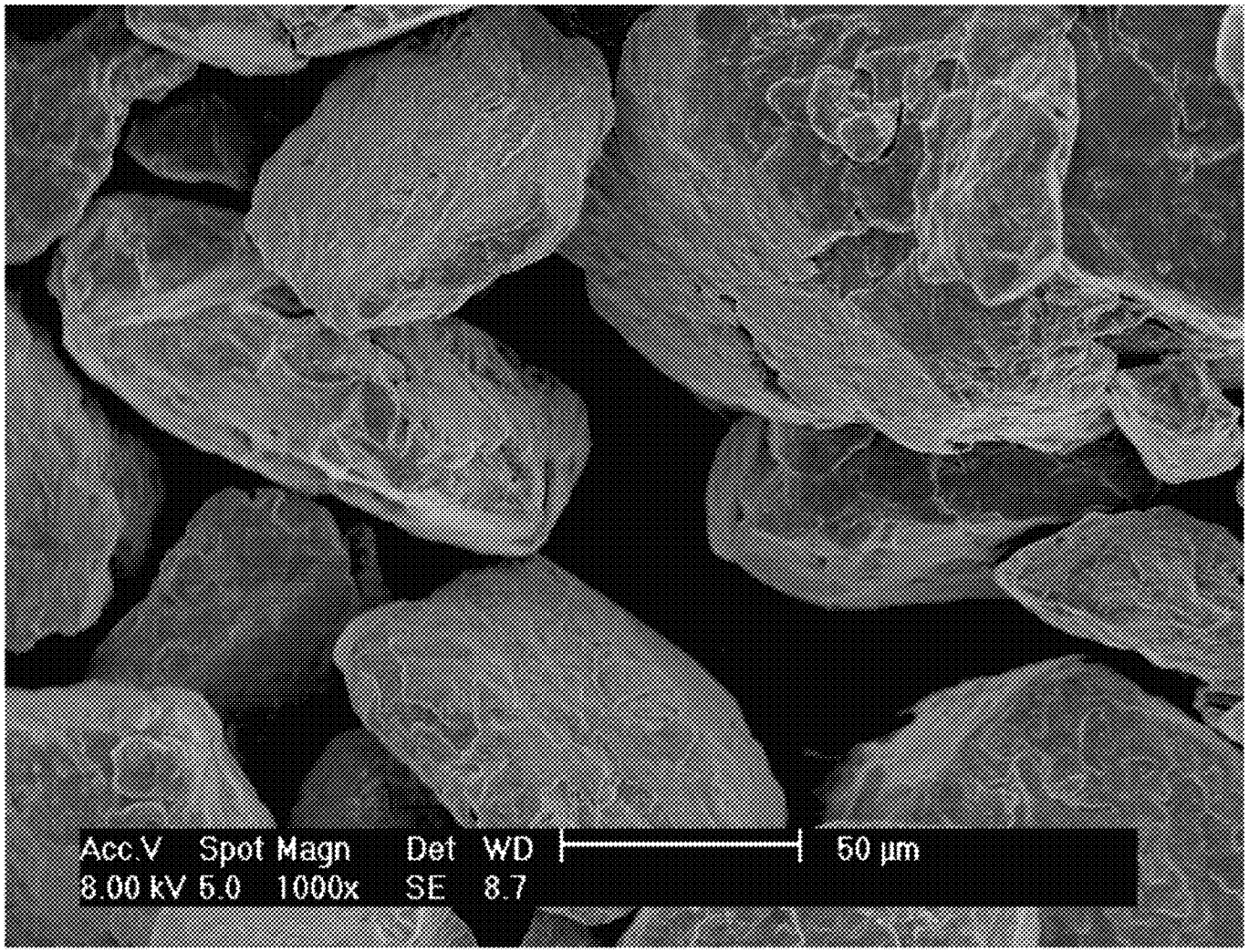

Referring now to FIGS. 6A through 6C, following milling, the nanostructured AA5083 powder produced had the following characteristics:

Tap density=1.45 g/cc

Particle size distribution (Horiba LA-920 particle size analyzer): D10=73 μm; D50=117 μm; D95=255 μm Average crystallite size estimated according to the Scherrer method=26 nm Notwithstanding the above illustrative embodiment, the planetary mill 10 of the present invention can be used for numerous other specific applications where energy mills are currently being used, for example mechano-chemical processing of complex oxides, chemical transformations, mechanical alloying, production of intermetallic compound powders, processing of metal-ceramic composites, surface modification of metal powder, precursors for spark plasma sintering, mechanochemical doping, soft mechanochemical synthesis of materials, diminution of particles for surface activation, and the like.

Although the present invention has been described hereinabove by way of specific embodiments thereof, it can be modified, without departing from the spirit and nature of the subject invention as defined in the appended claims.

What is claimed is:

1. A planetary mill comprising:

a self-balancing milling assembly comprising a pair of elongate floating milling chambers arranged in parallel to and on opposite sides of a main axis wherein said milling chambers are free to move outwards in a direction radial to said main axis;

a drive assembly for rotating said milling assembly in a first direction of rotation about said main axis; and at least one belt surrounding said pair of floating milling chambers such that when said milling assembly rotates about said main axis, said at least one belt limits a radial travel outwards of each of said milling chambers wherein said at least one belt and said milling chambers are made of a heat conducting material, wherein said milling chambers produce heat during milling and further wherein said belts cool an outer surface of said milling chambers by conducting said heat away from said mining chambers.

2. The planetary mill of claim 1, comprising a plurality of said belts arranged side-by-side.

3. The planetary mill of claim 1, wherein said at least one belt polishes an outer surface of said chambers thereby improving a conductive contact between an inner surface of said at least one belt and said outer surface of said milling chambers.

4. The planetary mill of claim 1, wherein said drive assembly rotates each of said milling chambers about their respective axis in a second direction of rotation.

5. The planetary mill of claim 4, wherein said second direction of rotation is opposite to said first direction of rotation.

6. The planetary mill of claim 4, wherein said drive assembly comprises a single source of motive power.

7. The planetary mill of claim 1, wherein said at least one belt comprises a chain belt.

8. The planetary mill of claim 1, wherein said milling chambers are substantially the same size and weight and further wherein said milling chambers are arranged equidistantly from said main axis.

9. The planetary mill of claim 1, wherein a width of said at least one belt is greater than at least half a length of one of said milling chambers.

10. The planetary mill of claim 1, further comprising an enclosure encompassing said milling chambers and a cooling system comprising at least one nozzle for directing coolant onto said milling chambers.

11. A mill comprising:

a pair of elongate cylindrical milling chambers arranged on opposite sides of a main axis;

a drive assembly for rotating said milling assembly in a first direction of rotation about said main axis; and at least one belt surrounding said pair of milling chambers and positioned towards a center thereof;

wherein in operation, said elongate cylindrical milling chambers remain in parallel to said main axis.

12. The mill of claim 11, comprising a plurality of said belts arranged side by side.

13. The mill of claim 11, wherein said at least one belt is a chain belt.

14. The mill of claim 13, wherein said at least one chain belt has a pitch which is less than ⅛th of the radius of an outer surface of either of said elongate cylindrical milling chambers.

* * * * *